US005160241A

United States Patent [19]

Glynn

[11] Patent Number: 5,160,241

[45] Date of Patent: Nov. 3, 1992

[54] MULTI-PORT AIR CHANNELING ASSEMBLY

[75] Inventor: Christopher C. Glynn, Hamilton, Ohio

[73] Assignee: General Electric Company, Cincinnati, Ohio

[21] Appl. No.: 756,654

[22] Filed: Sep. 9, 1991

[51] Int. Cl.[5] ..... F01D 25/24

[52] U.S. Cl. ..... 415/175; 415/116; 415/144

[58] Field of Search ..... 415/115, 116, 144, 171.1, 415/176, 175; 60/39.07

[56] References Cited

U.S. PATENT DOCUMENTS

| | | | |
|---|---|---|---|
| 2,837,270 | 6/1958 | Chapman | 230/115 |
| 3,398,881 | 8/1968 | Greenberg et al. | 415/144 |
| 3,597,106 | 8/1971 | Anderson | 415/144 |
| 3,632,223 | 1/1972 | Hampton | 415/144 |
| 4,053,254 | 11/1977 | Chaplin et al. | 415/116 |
| 4,155,680 | 5/1979 | Linko, III et al. | 415/144 |
| 4,187,054 | 2/1980 | Landis, Jr. et al. | 415/115 |
| 4,213,296 | 7/1980 | Schwarz | 415/116 |
| 4,303,371 | 12/1981 | Eckert | 415/175 |
| 4,329,144 | 5/1982 | Johnston et al. | 60/39.07 |
| 4,379,677 | 4/1983 | Hallinger et al. | 415/175 |
| 4,826,397 | 5/1989 | Shook et al. | 415/175 |
| 5,092,735 | 3/1992 | Katy et al. | 415/115 |

*Primary Examiner*—Edward K. Look
*Assistant Examiner*—Michael S. Lee
*Attorney, Agent, or Firm*—Jerome C. Squillaro

[57] ABSTRACT

An air channeling assembly includes an outer casing having a series of spaced apart air ports spaced radially outwardly from an inner casing to define a plenum therebetween. A series of baffles are disposed in the plenum and spaced radially inwardly from the outer casing. Each of the baffles includes an intermediate opening joined in flow communication with a respective one of the air ports, and first and second ends extending circumferentially oppositely away from the intermediate opening. The baffle provides a flow shield between the inner and outer casing around each of the air ports and channels air through the intermediate opening and respective air ports.

11 Claims, 4 Drawing Sheets

MULTI-PORT AIR CHANNELING ASSEMBLY

TECHNICAL FIELD

The present invention relates generally to gas turbine engines, and, more specifically, to an assembly for channeling air into or out of a turbomachine casing.

BACKGROUND ART

Conventional gas turbine engines include compressors for pressurizing air which is then mixed with fuel and ignited to undergo combustion with the resulting combustion gases being channeled through a turbine. The compressor and turbine are surrounded by casings through which air is either extracted or distributed.

More specifically, in a compressor, a portion of the air compressed therein is typically extracted as bleed air for conventional use in either an aircraft being powered by the engine, or in the turbine for obtaining preferential cooling thereof. The bleed air extracted from the compressor or distributed to the turbine is typically channeled through a plurality of circumferentially spaced apart air ports in the respective casings.

In the compressor, an inner casing or flowpath is typically spaced radially inwardly from the outer casing and surrounds conventional rotor blades and stator vanes which are mounted thereto. The inner casing includes a plurality of circumferentially spaced conventional bleed holes which channel a portion of the air compressed by the blades into the plenum defined between the outer and inner casings. The bleed air then flows circumferentially in the plenum to the nearest air port through which it is discharged from the compressor. The velocity of the bleed air is relatively low between adjacent ones of the air ports and relatively high at each of the air ports through which the air is being funneled out of the compressor.

Accordingly, the heat transfer capability of the bleed air, which is directly proportional to the velocity thereof, is relatively low between the air ports and relatively high at the air port. This variation in heat transfer capability of the bleed air leads to circumferential thermal distortion of the outer casing. For example, as the bleed air heats the outer casing, the outer casing at the air ports will expand more than the casing between the air ports causing the outer casing to become out of round. Since the inner casing is supported by the outer casing, the inner casing also becomes out of round which is undesirable since the inner casing surrounds the rotor blades, and increased clearance between the blade tips and the inner casing results in a decrease of compressor efficiency.

In the turbine, the bleed air is channeled therein through a plurality of circumferentially spaced apart air ports for circumferential distribution therein. Similarly, the velocity of the bleed air channeled into the turbine is greatest as it flows through the air ports and decreases between the air ports. Similar circumferential thermal distortion also results in the turbine casing.

OBJECTS OF THE INVENTION

Accordingly, one object of the present invention is to provide a new and improved assembly for channeling air into or out of a turbomachine casing.

Another object of the present invention is to provide an air channeling assembly for reducing circumferential thermal distortion in a turbomachine casing.

DISCLOSURE OF INVENTION

An air channeling assembly includes an outer casing having a plurality of spaced apart air ports spaced radially outwardly from an inner casing to define a plenum therebetween. A plurality of baffles are disposed in the plenum and spaced radially inwardly from the outer casing. Each of the baffles includes an intermediate opening joined in flow communication with a respective one of the air ports, and first and second ends extending circumferentially oppositely away from the intermediate opening. The baffle provides a flow shield between the inner and outer casing around each of the air ports and channels air through the intermediate opening and respective air ports.

BRIEF DESCRIPTION OF DRAWINGS

The novel features characteristic of the invention are set forth and differentiated in the claims. The invention, in accordance with preferred and exemplary embodiments, together with further objects and advantages thereof, is more particularly described in the following detailed description taken in conjunction with the accompanying drawings in which:

MODE(S) FOR CARRYING OUT THE INVENTION

Figure 1:
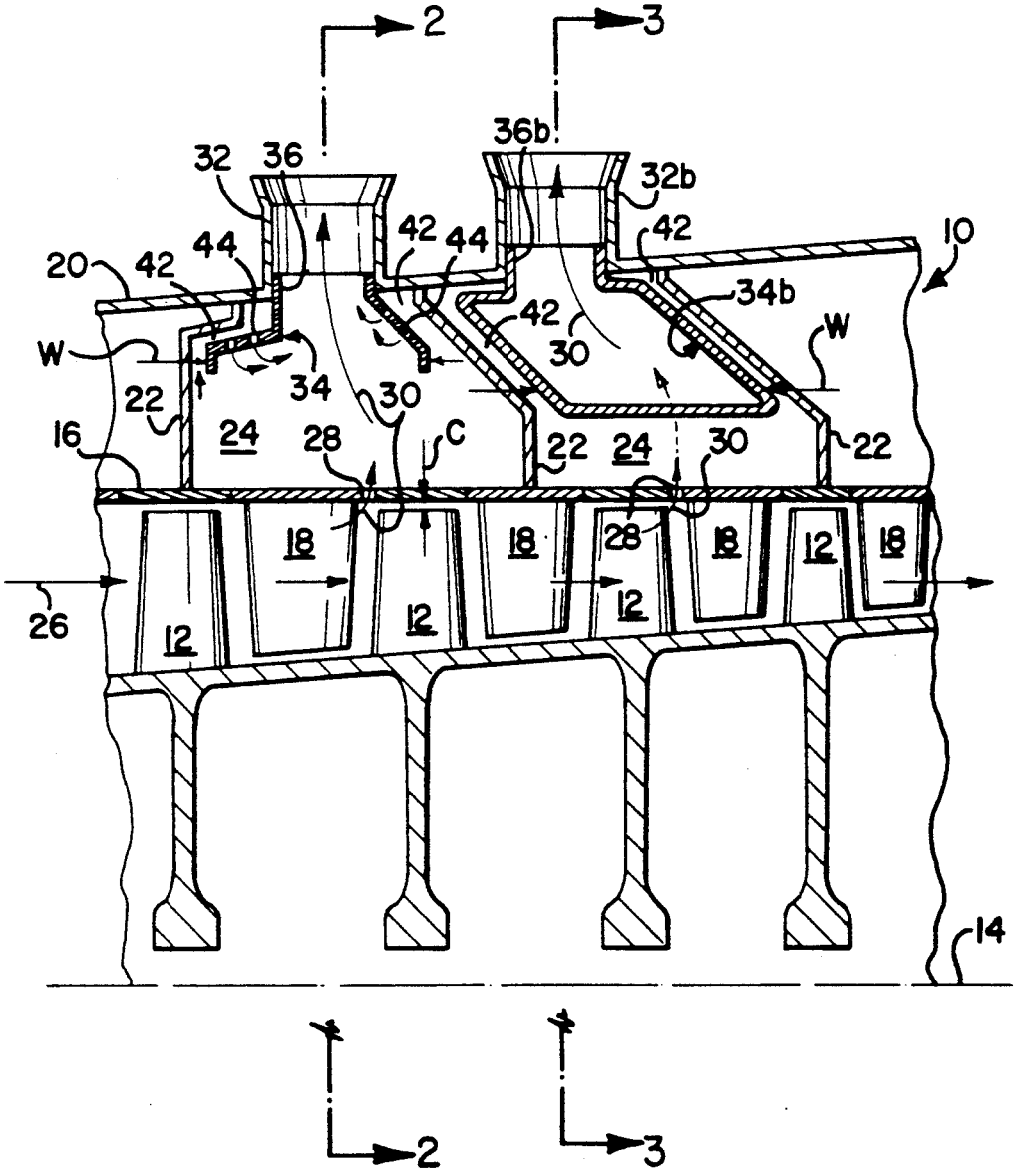
FIG. 1 is a schematic, partly sectional axial view of an exemplary gas turbine engine compressor having an air channeling assembly in accordance with two embodiments of the present invention.

Illustrated schematically in FIG. 1 is a portion of an exemplary axial flow compressor 10 of a gas turbine engine. The compressor 10 conventionally includes several stages or rows of a plurality of circumferentially spaced apart rotor blades 12 disposed coaxially about a longitudinal axial centerline axis 14. The rotor blades 12 are disposed radially inwardly of a conventional inner casing or flowpath 16 which conventionally supports several rows of a plurality of circumferentially spaced apart stator vanes 18.

The inner casing 16 is disposed radially inwardly from a conventional annular outer casing 20 and is supported thereby by a plurality of conventional axially spaced apart supports 22. The inner casing 16 is disposed coaxially with the outer casing 20 about the longitudinal axis 14 and defines therebetween an annular plenum 24 through which the supports 22 extend.

During conventional operation of the compressor 10, air 26 flows axially downstream through the several rows of blades 12 and vanes 18 and is compressed thereby. The inner casing 16 is spaced radially outwardly from the tips of the blades 12 to define a tip clearance C which is made as small as possible to prevent leakage of the compressed air 26 therethrough which decreases efficiency of the compressor 10. The inner casing 16 also includes a plurality of circumferentially spaced apart conventional bleed holes 28 for channeling a portion of the compressed air 26 as bleed air 30 into the plenum 24. The bleed air 30 may be extracted through the inner casing 16 at several axial locations or stages as is conventionally known, with extraction at two stages being illustrated in FIG. 1.

Figure 2:
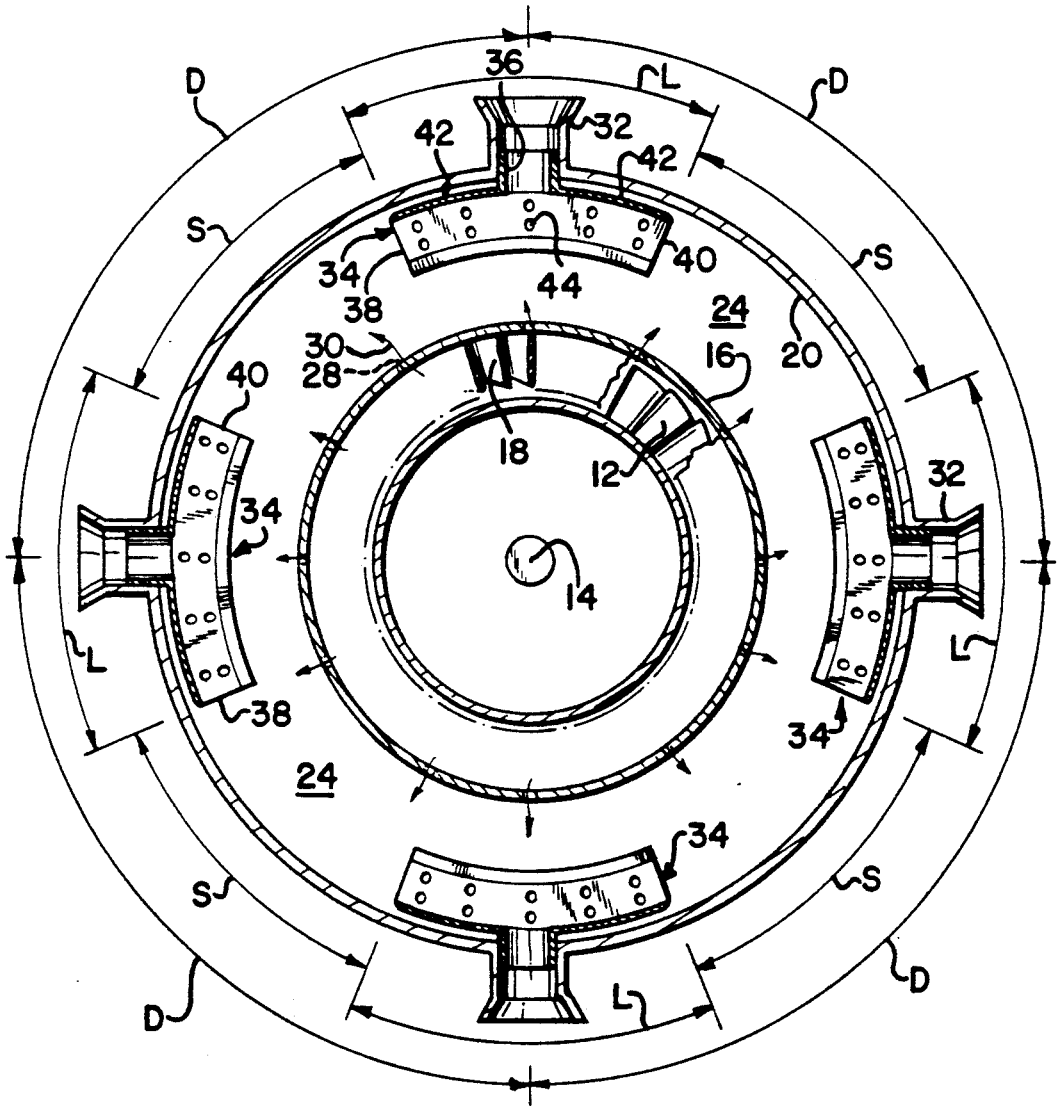
FIG. 2 is a sectional view of the compressor illustrated in FIG. 1 taken along line 2—2 showing the first embodiment of the air channeling assembly.
Figure 3:
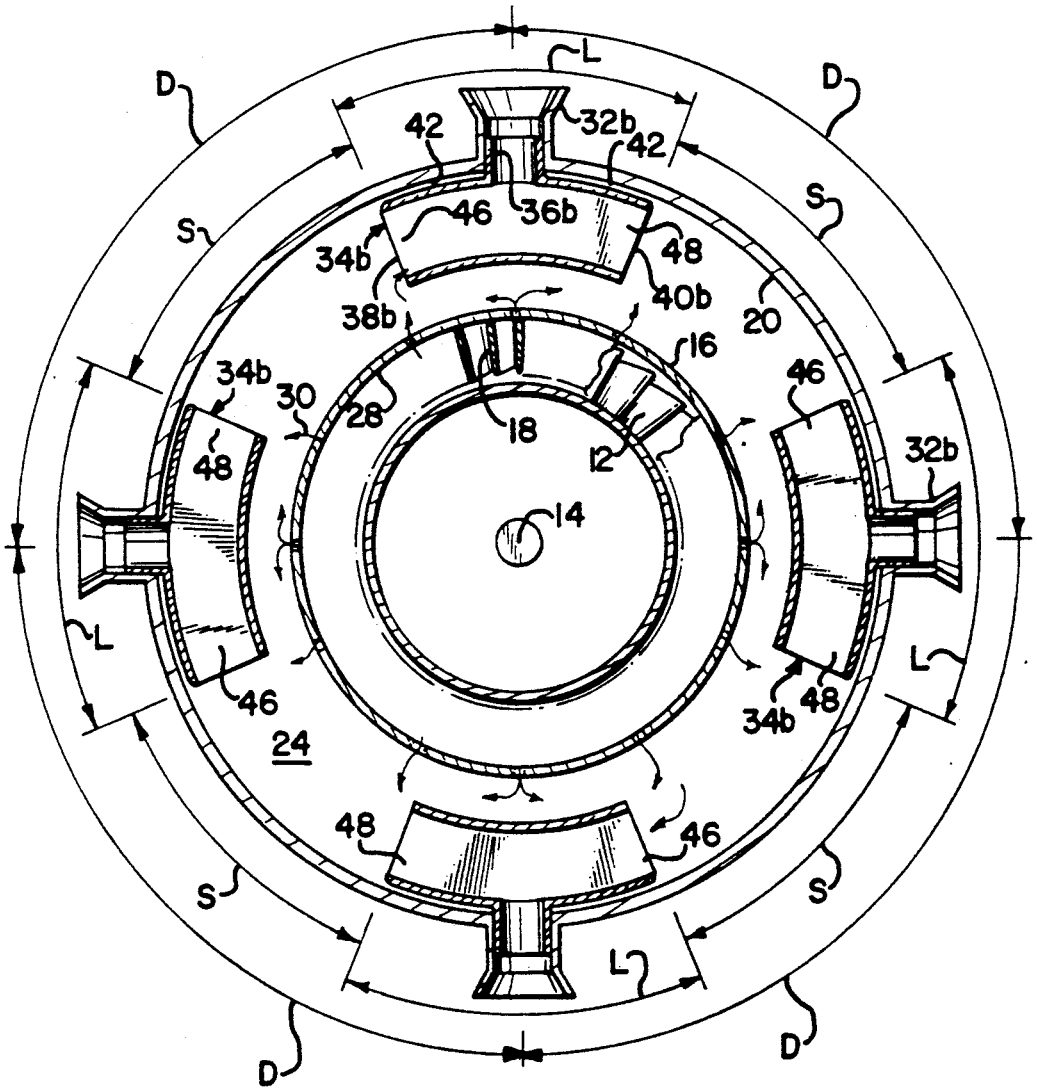
FIG. 3 is a sectional view of the compressor illustrated in FIG. 1 taken along line 3—3 showing the second embodiment of the air channeling assembly.

The bleed air 30 is collected in the plenum 24 between respective ones of the supports 22 and is channeled radially outwardly through the outer casing 20 through a plurality of circumferentially spaced apart conventional air ports designated 32 and **32*b* for the two bleed air extraction stages illustrated. At least two circumferentially spaced apart air ports are used for each stage, with three, or four as shown in FIGS. 2 and 3, or more being used as desired. In a conventional bleed air assembly, the bleed air 30 flows from the bleed holes 28 between adjacent ones of the air ports 32 circumferentially to discharge from the nearest air port 32. Accordingly, the velocity of the bleed air 30, and its heat transfer capability, varies from circumferentially between adjacent air ports 32 to the air ports 32. If the bleed air 30 is allowed to flow circumferentially along the inner surface of the outer casing 20**, circumferential thermal distortions will be created due to the uneven heating thereof, for example.

In accordance with the present invention, an air channeling assembly is provided for each of the bleed air stages for reducing the circumferential thermal distortion of the outer casing 20. Since the outer casing 20 supports the inner casing 16, circumferential thermal distortion of the outer casing 20 creates a corresponding circumferential thermal distortion of the inner casing 16, which increases the tip clearance C at corresponding circumferential positions along the inner casing 16 which increases leakage of the compressed air 26 therethrough. By reducing the circumferential thermal distortion of the outer casing 20, the corresponding circumferential thermal distortion of the inner casing 16 is also reduced, and the circumferential variation of the tip clearance C is in turn reduced for reducing efficiency losses of the compressor 10 due to leakage of the compressed air 26 therethrough.

Figure 4:
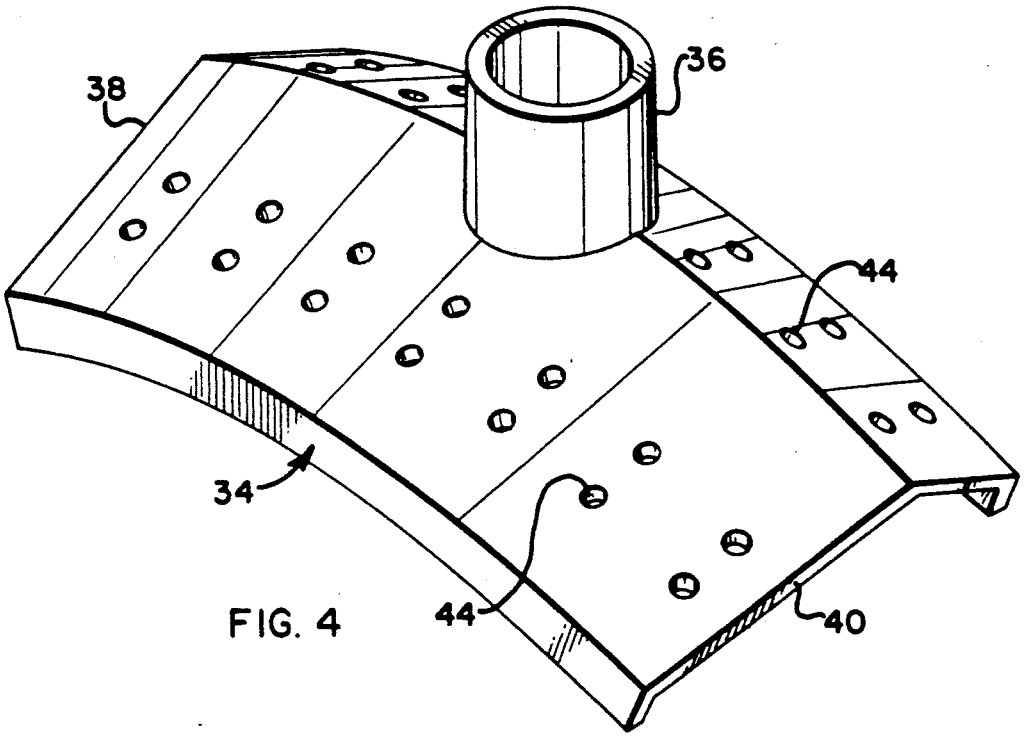
FIG. 4 is a perspective view of one of the first baffles utilized in the first embodiment of the air channeling assembly illustrated in FIGS. 1 and 2.

The air channeling assembly is illustrated in FIGS. 1 and 2 in an exemplary first embodiment for the air ports 32, designated herein as the first air ports 32. The assembly includes the outer casing 20 with the first air ports 32, the inner casing 16, and the plenum 24 defined between respective supports 22 which collects the bleed air 30 from the bleed holes 28 for flow through the first air ports 32. A plurality of circumferentially extending, arcuate flow baffles, which, in one embodiment, are simple plates designated first baffles 34 are disposed inside the plenum 24 radially inwardly from the outer casing 20 below the first air ports 32. More specifically, each of the first baffles 34 as illustrated in FIGS. 1, 2, and 4 includes an intermediate, preferably center, tubular opening 36 conventionally joined in flow communication with a respective one of the first air ports 32, by being brazed thereto for example, and first and second ends 38, 40 extending circumferentially oppositely away from the intermediate opening 36. The first baffle 34, therefore, provides a flow shield between the inner casing 16 and the outer casing 20 around each of the first air ports 32 and channels air through the baffle intermediate opening 36 and the respective first air port 32.

In this first embodiment of the invention, the bleed air 30 flows from the several bleed holes 28 radially outwardly toward the first air ports 32 and is funneled therein by the first baffles 34. The first baffles 34 are spaced radially inwardly from the outer casing 20 to define a thermal insulating space 42 therebetween and shield the outer casing 20 from direct contact with the bleed air 30. Without the first baffles 34, the bleed air 30 would flow along the inner surface of the outer casing 20 into the first air ports 32 and provide uneven heating of the outer casing 20 and resulting circumferential distortion thereof. With the first baffles 34, the bleed air 30 flows along the inner surfaces of the first baffles 34 and is funneled into the first air ports 32 by the intermediate openings 36. The first baffles 34, therefore, reduce the heat transfer at the outer casing 20 around the first air ports 32, and therefore, reduce the circumferential thermal distortion in the outer casing 20.

As illustrated in FIG. 2, each of the first baffles 34 has an arcuate length L between the first and second ends 38, 40 measured in degrees relative to the circumference of the outer casing 20 about the centerline axis 14. And, adjacent ones of the first and second ends 38, 40 of adjacent first baffles 34 are circumferentially spaced apart at an arcuate spacing S also similarly measured in degrees, with all the arcuate lengths L and spacings S being equal to each other in this preferred embodiment. In this way, the first baffles 32 are equiangularly spaced apart around the outer casing 20 for providing more uniformity of heat transfer capability of the bleed air 30 with respect to each of the first baffles 34 and the first air ports 32. Also in this preferred embodiment, each of the first air ports 32 is disposed equidistantly, or equiangularly between the first and second ends 38, 40 of the respective first baffles 34, i.e. at the angular distance L/2.

In the exemplary first embodiment illustrated in FIG. 2, four of the first air ports 32 are provided and are preferably equiangularly spaced apart at an arcuate distance D of 90° on center. Correspondingly, four of the first baffles 34 are provided with each of the baffles having an arcuate length L of about 45°, with the arcuate spacing S between adjacent baffles being about 45°. In alternate embodiments, the values of D, L, and S may be unequal as desired, and each may be varied for each of the air ports 32 up to about plus or minus 15° for example.

As illustrated in FIG. 1, each of the first baffles 34 has a width W in its transverse direction, i.e. parallel to the centerline axis 14, which is selected so that the forward and aft sides of the first baffle 34 are disposed adjacent to the respective supports 22 in the plenum 24 wherein the bleed air 30 is collected. In this way, the bleed air 30 is funneled axially as well as circumferentially by the first baffles 34 into the respective intermediate openings 36. Since the intermediate opening 36 is disposed in flow communication with the first air port 32, with its outer surface being sealed to the inner surface of the first air port 32, by brazing for example, the bleed air 30 will not flow around the top side of the first baffles 34 toward the outer casing 20, and the space 42, therefore, provides a thermal insulating barrier to the outer casing 20 and the supports 22 adjacent to the first air ports 32. For steady state operation of the compressor 10, the circumferential thermal distortions in the outer casing 20 will be reduced by the first baffles 34. The first baffles 34 may be imperforate between the intermediate opening 36 and the first and second ends 38, 40, or as shown for the first baffles 34 illustrated in FIGS. 1, 2, and 4, may include a plurality of spaced apart extraction holes 44 facing the outer casing 20 for bleeding air radially inwardly into the first baffles 34 from the insulating space 42 adjacent to the outer casing 20. The extraction holes 44 may be utilized where transient response of the outer casing 20 requires additional heating thereof, in which case, a portion of the bleed air 30 channeled initially radially outwardly around the first baffles 34, through the insulating space 42 and then radially inwardly through the holes 44 in the baffles 34 will additionally heat the outer casing 20. However, during steady state operation of the compressor 10, the additional heating from channeling a portion of the bleed air 30 through the extraction holes 44 is relatively minor when compared to the overall reducing of the heating of the outer casing 20 affected by the first baffles 34. For example, the extraction holes 44 may be collectively sized for channeling therethrough only about one percent, or less, of the total bleed air channeled from the bleed holes 28 through the first air ports 32.

Figure 5:
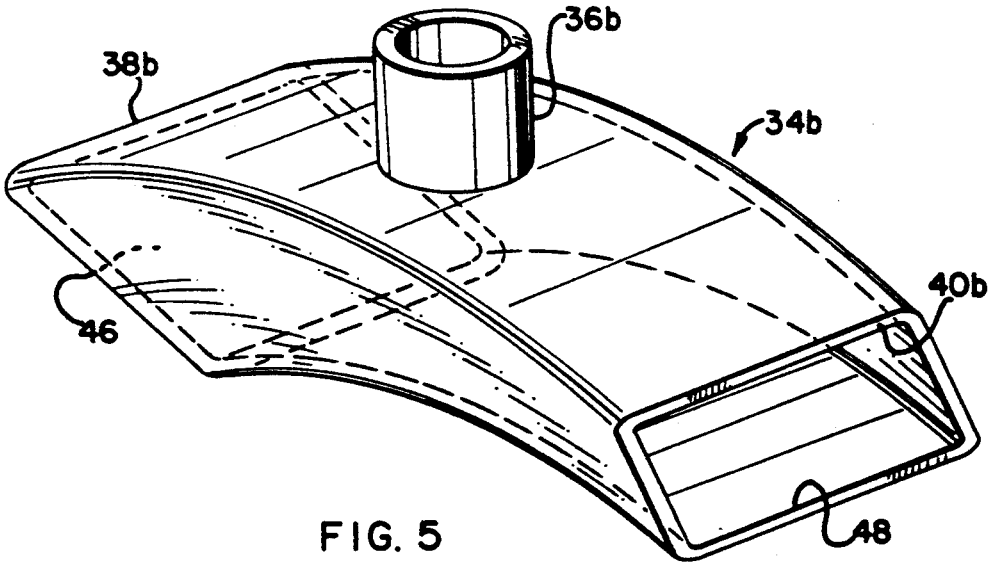
FIG. 5 is a perspective view of one of the second baffles utilized in the second embodiment of the air channeling assembly illustrated in FIGS. 1 and 2.

Although the first baffles 34 illustrated in FIGS. 1, 2, and 4 are in the form of plates, the baffles may also be tubular, i.e. In the form of a tube, as illustrated in FIGS. 1, 3, and 5 and designated as second baffles **34*b* for channeling the bleed air 30 from a different, downstream, stage of the compressor 10 into the second air ports 32*b*. In this second embodiment, the baffle first and second ends 38*b*, 40*b* are tubular in transverse section, and, therefore, define respective tubular first and second openings 46, 48, respectively, in flow communication with the baffle intermediate opening 36*b* and respective second air port 32*b*. As shown in FIGS. 1 and 5, the second baffles 34*b* are preferably complementary in transverse section with the plenum 24 between the adjacent supports 22 e.g. trapezoidal, to provide sufficient flow area for reducing pressure drop of the bleed air 30 channeled through the second baffles 34*b* and out the second air ports 32*b***.

More specifically, each of the second air ports **32*b* is conventionally designed to have a flow area for collectively channeling the bleed air 30 from the bleed holes 28 with reduced pressure drops for reducing efficiency losses. Since the bleed air 30 must flow firstly through the respective first and second openings 46 and 48 before being discharged through the intermediate opening 36*b* into the second air port 32*b*, the openings 46, 48 must each have a suitable flow area which collectively are at least as large as about the flow area of the intermediate opening 36*b*. For each of the second air ports 32*b*, two circumferentially spaced apart inlets thereto are therefore provided, i.e. the first and second openings 46 and 48**.

In the preferred embodiment illustrated in FIG. 3, four of the second air ports **32*b* are provided and are equiangularly spaced apart the distance D of 90° on center. Four of the second baffles 34*b* are also provided with each baffle preferably having the arcuate length L of about 45°, and being spaced from the adjacent baffles at the arcuate spacing S of about 45° for providing eight equiangularly spaced apart ones of the baffle first and second openings 46 and 48. In alternate embodiments, more or less air ports 32*b* may be used with a corresponding number of baffles 34*b***, either equiangularly spaced apart, or not, as desired. The values of D, L, and S may also be chosen to be equal to each other, or not, as desired.

The second baffles **34*b* are preferably imperforate between the intermediate opening 36*b* and the first and second openings 46 and 48 and, therefore, the bleed air 30 must flow circumferentially through the first and second openings 46, 48 before being discharged radially outwardly through the intermediate opening 36*b*. The second baffles 34*b* are similarly spaced radially inwardly from the outer casing 20 around the second air ports 32*b* and have axial widths W for defining the insulating space 42. During operation, the bleed air 30 from the several bleed holes 28 must flow circumferentially in the plenum 24 before turning into the respective first and second openings 46 and 48, and before being discharged through the intermediate opening 36*b* into the second air port 32*b*. Accordingly, the second baffles 34*b* reduce the heat transfer around each of the second air ports 32*b* since the bleed air 30 enters the first and second openings 46, 48 which are circumferentially spaced away from the second air ports 32*b*, e.g. at about L/2 or 45° therefrom. The velocity of the bleed air 30 will, therefore, be relatively larger in the plenum 24 between the second air ports 32*b* than it would without the baffles 34*b* since it is forced, or funneled, into the two circumferentially spaced apart first and second openings 46 and 48 instead of a single second air port 32*b*** as would occur conventionally.

Analysis of the second embodiment of the invention illustrated in FIG. 3 having the tubular second baffles **34*b* indicates a reduction of about 55° C. in circumferential temperature gradient around the outer casing 20 with a resultant reduction in radial distortion circumferentially around the inner casing 16** from about 0.25 mm to about 0.05 mm.

For the second embodiment of the invention illustrated in FIGS. 1, 3, and 5, the extraction holes 44 disclosed above for the first embodiment, could also be used if required for obtaining preferred transient response of the outer casing 20, although they are not necessary in this exemplary embodiment.

Although the air channeling assemblies disclosed above are particularly useful in a gas turbine engine compressor for collecting bleed air and discharging it through the air ports in the outer casing 20, the invention may also be used in turbines for distributing therein the bleed air 30 channeled thereto. Conventional turbines typically include a distribution manifold, like the plenum 24 illustrated in FIG. 1 surrounding the rotor blades and stator vanes thereof. Air ports similar to those illustrated in FIG. 1 are also provided for channeling the bleed air 30 into the turbine. The second baffles **34*b* may be advantageously utilized therein for channeling the bleed air 30 from the second air ports 32*b* and circumferentially outwardly from the two first and second baffle openings 46 and 48 for more uniformly distributing the bleed air 30 therein. Circumferential thermal distortion of the outer casing will accordingly be reduced, which also reduces the circumferential thermal distortion of the turbine inner casing which provides smaller blade tip clearances C in the turbine as well. Accordingly, the second embodiment of the invention illustrated in FIG. 1, including the second baffles 34*b* may also be used to schematically represent an assembly for channeling the bleed air 30 into the plenum 24** of a conventional turbine which is then conventionally used for cooling the turbine casing.

While there have been described herein what are considered to be preferred embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims.

I claim:

1. An air channeling assemblying for a gas turbine engine comprising:

an annular outer casing having a plurality of circumferentially spaced apart air ports;

an annular inner casing disposed coaxially with said outer casing and spaced radially inwardly therefrom to define a plenum; and a plurality of circumferentially extending, arcuate baffles, each baffle being spaced radially inwardly from said outer casing inside said plenum, and having an intermediate opening joined in flow communication with a respective one of said air ports, and first and second ends extending circumferentially oppositely away from said intermediate opening so that said baffle provides a flow shield between said inner casing and said outer casing around each of said air ports and channels air through said baffle intermediate opening and respective air port.

2. An assembly according to claim 1 wherein said baffles are equiangularly spaced apart around said outer casing.

3. An assembly according to claim 2 wherein each of said baffles has an arcuate length between said first and second ends, and adjacent ones of said first and second ends of adjacent baffles are circumferentially spaced apart at an arcuate spacing, all said arcuate lengths and spacings being equal to each other.

4. An assembly according to claim 3 wherein each of said air ports is disposed equiangularly between said first and second ends of a respective baffle.

5. An assembly according to claim 1 wherein each of said baffles is a plate.

6. An assembly according to claim 1 wherein each of said baffles is tubular and said baffle first and second ends define respective tubular first and second openings in flow communication with said baffle intermediate opening and said respective air port.

7. An assembly according to claim 6 further including:

a plurality of circumferentially spaced apart compressor rotor blades disposed radially inwardly of said inner casing; and a plurality of circumferentially spaced apart bleed holes disposed in said inner casing for channeling a portion of air compressed by said blades as bleed air into said plenum for flow through said baffle first and second openings, said baffle intermediate opening, and radially outwardly from said respective air port.

8. An assembly according to claim 7 wherein said tubular baffles are complementary in transverse section with said plenum; and said intermediate, first and second openings each has a flow area, with said flow area of said first and second openings being collectively at least as large as about said flow area of said intermediate opening.

9. An assembly according to claim 7 further including:

four of said air ports equiangularly spaced apart; and four of said baffles, each baffle having an arcuate length of about 45° and being spaced from an adjacent baffle at an arcuate spacing of about 45° for providing eight equiangularly spaced apart ones of said baffle first and second openings.

10. An assembly according to claim 9 wherein said baffles are imperforate between said intermediate opening and said first and second openings.

11. An assembly according to claim 9 wherein said baffles include a plurality of extraction holes facing said outer casing for bleeding air into said baffles from adjacent said outer casing.

* * * * *